US005598599A

United States Patent [19]

Haiduk

[11] Patent Number: 5,598,599

[45] Date of Patent: Feb. 4, 1997

[54] TOOTHBRUSH

[76] Inventor: Herbert Haiduk, Am Einsiedel 24 a, 91785 Pleinfeld, Germany

[21] Appl. No.: 408,850

[22] Filed: Mar. 22, 1995

[30] Foreign Application Priority Data

Mar. 23, 1994 [DE] Germany ..... 44 10 003.5

[51] Int. Cl.[6] ..... A46B 9/04

[52] U.S. Cl. ..... 15/176.6; 15/176.1; 15/167.1

[58] Field of Search ..... 15/167.1, 176.1, 15/176.6

[56] References Cited

U.S. PATENT DOCUMENTS

| | | | |
|---|---|---|---|
| 1,241,881 | 10/1917 | Picard . | |
| 2,226,814 | 12/1940 | Gregg . | |
| 3,229,318 | 1/1966 | Clemens | 15/167.1 |
| 4,890,732 | 1/1990 | Shackelford | 15/167.1 |
| 5,144,712 | 9/1992 | Hansel et al. | 15/176.6 |
| 5,146,645 | 9/1992 | Dirksing | 15/167.1 |
| 5,283,921 | 2/1994 | Ng | 15/176.6 |
| 5,373,702 | 12/1994 | Bang | 15/167.1 |

FOREIGN PATENT DOCUMENTS

| | | |
|---|---|---|
| 3345605 | 6/1985 | Germany . |
| 4019313 | 8/1991 | Germany . |
| 2247968 | 1/1948 | Switzerland . |
| A366460 | 10/1929 | United Kingdom . |
| A544870 | 4/1942 | United Kingdom . |

*Primary Examiner*—David Scherbel
*Assistant Examiner*—Terrence R. Till
*Attorney, Agent, or Firm*—Herbert Dubno

[57] ABSTRACT

A bent wire serves to form a loop for assembly receiving a brush head of a toothbrush, the bent wire also forming a pair of shanks which are received in a handle holding the shanks together to close the loop and return the brush head assembly therein. At least one of the shanks has formations indexable in the handle. Between the end portions of the shanks and the loop, coil springs are formed in the wire to allow mobility of the brush head in all directions perpendicular to the longitudinal axis thereof.

10 Claims, 4 Drawing Sheets

11
12
13
14
15
16
17
18
19
20
21
22
23
23'
23''
23'''
24
25
26
27
28
29
36
D
W
X
α

10
11
13
15
16
17
18
19
20
21
22
23
23'
24
26
29
36
37
D
x
w
α

TOOTHBRUSH

FIELD OF THE INVENTION

My present invention relates to a toothbrush having a head provided with bristles or the like for brushing of the teeth and which can be interchangeably or replaceably mounted in a shank portion to which a handle can be applied, the brush head having a limited degree of resilient mobility when in use.

BACKGROUND OF THE INVENTION

Toothbrushes in which the brush head is connected with the stem in such manner that some resilient mobility of the head can be provided, generally make use of a yieldable element in the stem which, upon pressing of the brush against the teeth or the gums can yield. Such systems have the drawbacks that the brush head, upon use, cannot generally move in all directions transverse to the longitudinal axis of the brush so that during such use, there is a danger of injury to the gums because of this lack of mobility of yielding in certain directions.

The problem is avoided in the toothbrush of German Patent 40 19 313 by connecting the brush head with the stem by an elastic member. In this system, the stem allows only relative movement between the brush head and the stem in the axial direction.

It is indeed advantageous that the elastic element prevents the axial forces from injuring the teeth and the soft tissue around the teeth, but here again the inability to yield to movements transverse to the longitudinal axis poses a problem.

This latter toothbrush, moreover, is of complex construction and comparatively expensive.

OBJECTS OF THE INVENTION

It is the principal object of the present invention to provide an improved toothbrush of simple construction and which can avoid injury, especially to the soft tissue around the teeth, while being able to be handled more conveniently than earlier toothbrushes.

Another object of this invention is to provide an improved toothbrush which has increased versatility in relative movements of the brush head and the stem and particularly which will allow movement of the head in substantially all directions transverse to the axis of the head.

In another object of the invention, the toothbrush improves upon earlier systems and eliminates drawbacks thereof.

SUMMARY OF THE INVENTION

These objects and others which will become apparent hereinafter are attained, in accordance with the invention, in a toothbrush having an elongated brush head received in a loop formed in a spring wire stem having two shanks engaged in or by a handle portion, the two shanks, in turn, being formed with helical coils of the spring wire which advantageously have axes inclined outwardly from the axis of the brush head and provides resilient means affording elastic mobility of the brush head in all directions transverse to the axis thereof. The two shanks can be engaged by a handle which is releasable or disengageable from the stem and thus allows spreading of the loop for removal of the brush head and replacement.

The toothbrush of the invention thus can comprise:

an elongated brush head having a longitudinal axis;

a support formed from a continuous spring-steel wire and defining an elongated loop constituting a head portion receiving the brush head and a stem portion connected with the head portion and formed by two shanks of the wire, the shanks being formed with respective coil springs, each of the coil springs having a plurality of turns of the wire enabling elastic displacement of the head in all directions transverse to the axis of the head, the shanks having end portions extending away from the springs; and a handle removably fitting over the end portions for drawing the end portions together and closing the loop to retain the brush head in the head portion, the loop opening to release the brush head upon release by the handle of the end portions.

The toothbrush of the invention has the advantage that the stem and loop portions can be formed from a single one-piece spring steel wire whose end portions can be clamped in a handle or grip portion. In each shank, therefore, there is at least one spring with a plurality of spring turns. The stem and the head can move relatively in all directions transverse to the longitudinal axis of the brush during the brushing movements. This means that the danger of injury, especially to the soft tissue around the teeth, can be minimized by the yieldability of the toothbrush.

While German Patent document DE-OS 33 45 605 does indeed disclose a toothbrush with replaceable brush heads and which is composed of a steel wire, in this technique the steel wire provides a closed frame in which the head is received and which is itself extremely stiff and inelastic to the point that the brush head has no significant resilient deflectability relative to the stem.

By comparison, the toothbrush of the invention has a highly mobile head and is easily handled. With separation of the end of the shanks by their removal from the handle, the loop of the head receiving the brush head can open to allow the brush head to be replaced. It thus is possible not only to replace a soiled or worn brush head in a highly simple manner but it is also possible to introduce the toothbrush into a sterilizer or rinsing apparatus for vigorous treatment of the toothbrush since the body of the toothbrush, composed of spring steel, is heat-resistant.

In use of the toothbrush, because of the spring wire which is employed, excess liquid and toothpaste can drop in the wash basin and need not pass downwardly into the handle so that both the hands of the user and the clothing of the user remain unsoiled. The smooth nonrusting surface of the steel wire provides little place for bacteria to accumulate and grow so that the toothbrush of the invention, from a hygienic point of view, is highly advantageous.

The toothbrush of the invention can be fabricated highly economically since it utilizes a single wire whose shank ends can be received in a corresponding recess or space of the handle. Fabrication of the handle and the wire does not require any critical dimensioning or great precision, thereby lowering the fabrication cost.

Before the initial use of the toothbrush of the invention, it is possible to bend the toothbrush so that it will be true to the mouth of the user.

Another feature of the toothbrush of the invention is that it has a relatively long useful life, at the end of which recycling of the steel member, namely the wire, is possible. The handle can also be recycled in a simple manner.

According to a feature of the invention, each of the springs has a coil axis inclined to the longitudinal axis of the toothbrush and head, extending downwardly toward the end portions. This arrangement of the turns of the spring in the shanks of the stem has been found to provide optimum mobility of the head of the brush upon brushing of the teeth. Because of the longitudinal axis of the toothbrush, it is possible to differently increase the mobility of the head part or to decrease the latter. The spring resistance or spring force can also be varied.

A further increase in the mobility of the head can be achieved by providing at least one of the end portions of the shank so that it is displaceable toward the longitudinal axis as the handle is slid over the shanks. This embodiment of the invention can be coupled with an electric drive in the handle which has set the end portions of the shanks in vibration to transmit vibration to the brush head.

Advantageously, both end portions of the shanks are receivable in the longitudinal or axial direction in the handle, the shanks pressing resiliently against the handle. A force is thus exerted on the head portion by the handle counter to a spring force of wire.

The handle can have a guide track for the end portions formed with openings in which at least one of the end portions is indexable, thereby properly positioning the handle on the end portions.

At least one of the end portions can be formed with a spring element, e.g. a bend in the wire, biasing it into one of the openings.

The wire of the handles are preferably composed of V4A medicinal steel.

I can provide a housing which receives the handle and is mountable on a support, e.g. a wall, the housing having a compartment receiving at least one brush head.

Advantageously, the handle can be formed on an end turned toward the head portion with a thumb rest. The loop engaging the brush head can be formed on opposite sides of the head with oppositely extending juts, fitting into corresponding recesses formed in the brush head.

The movement of the head portion of the toothbrush relative to the handle is thus limited by the indexing of the end portions in the openings. However, the force retaining the end portions in the opening is limited so if impact between the brush head and the teeth or the soft tissue of the mouth occurs in an axial direction which might be detrimental or injurious to the user, the spring-loaded end portions of the shanks can be pressed together and can slide further into the handle to minimize such impact. It will be apparent that the system of the invention, therefore, allows mobility in the axial direction as well as in all directions perpendicular to the axes.

BRIEF DESCRIPTION OF THE DRAWING

The above and other objects, features, and advantages will become more readily apparent from the following description, reference being made to the accompanying drawing in which.

Figures 1, 2, 3, 4A, 4B, 4C, 5, 6:
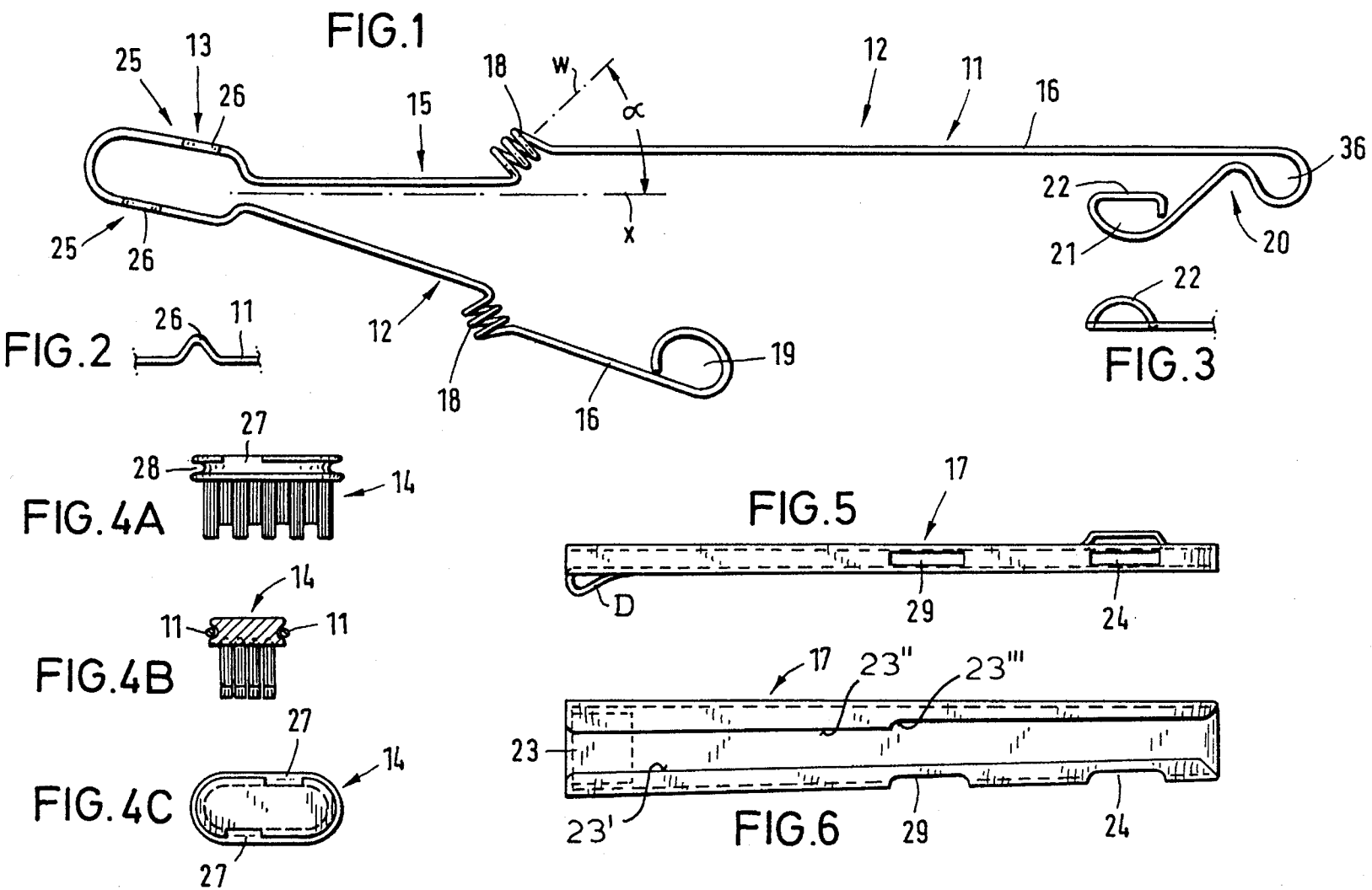
FIG. 1 is a plan view of the bent wire forming a head portion and stem portion of a toothbrush according to the invention.
Figures 7, 8, 9:
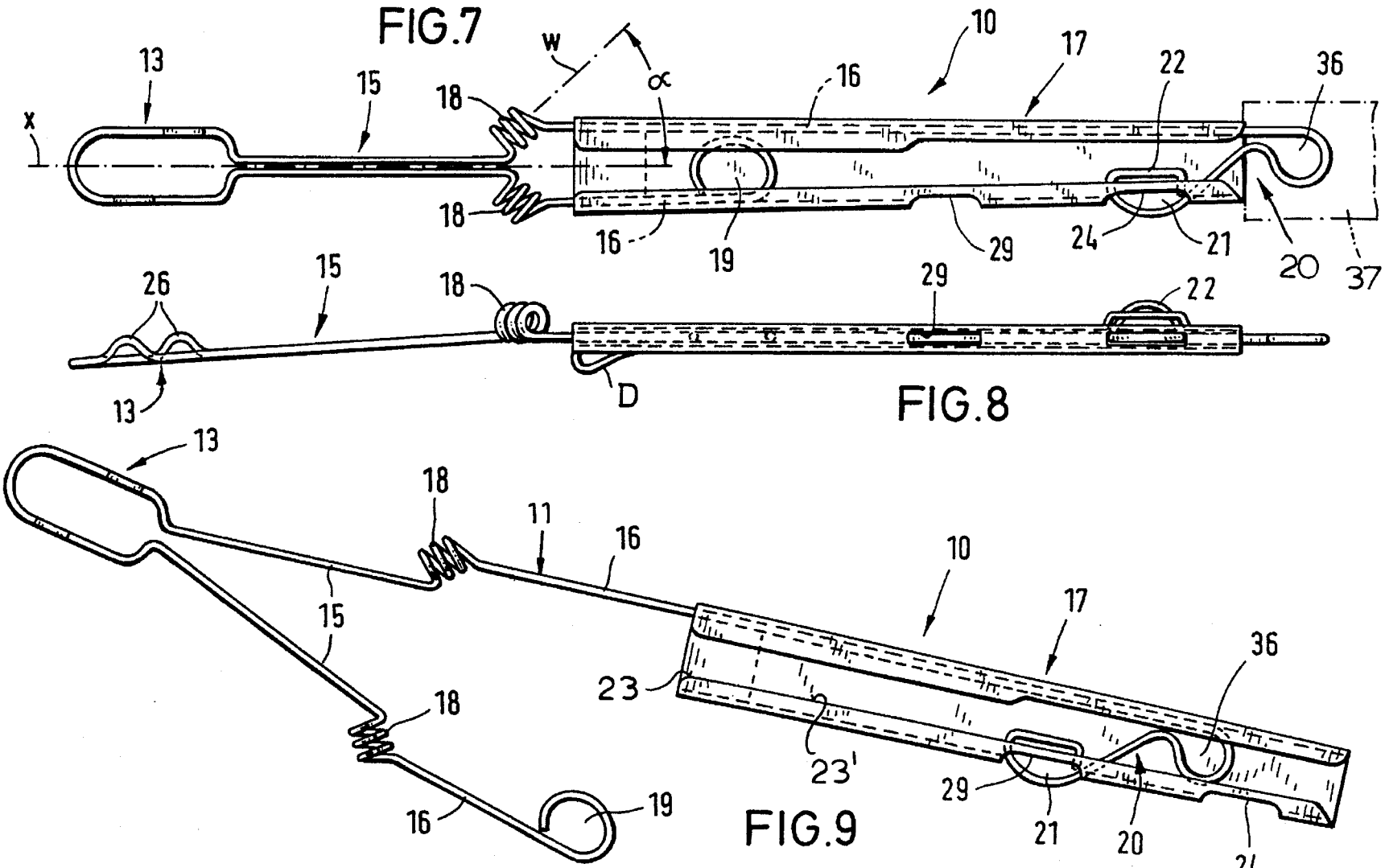
Figure 10:
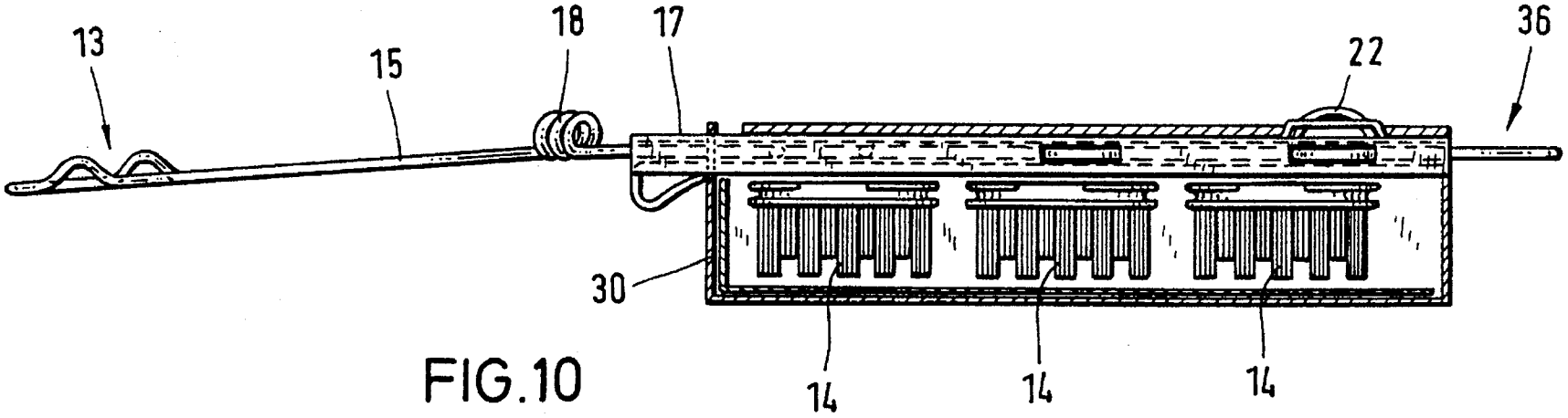
Figure 11:
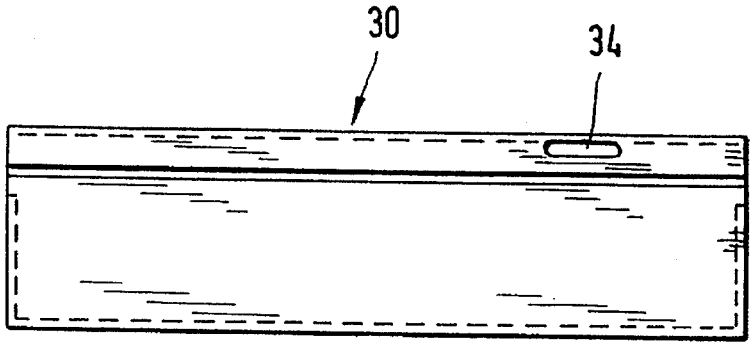
Figure 12:
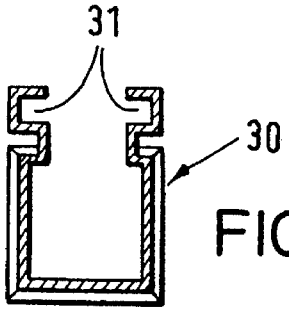
Figure 13:
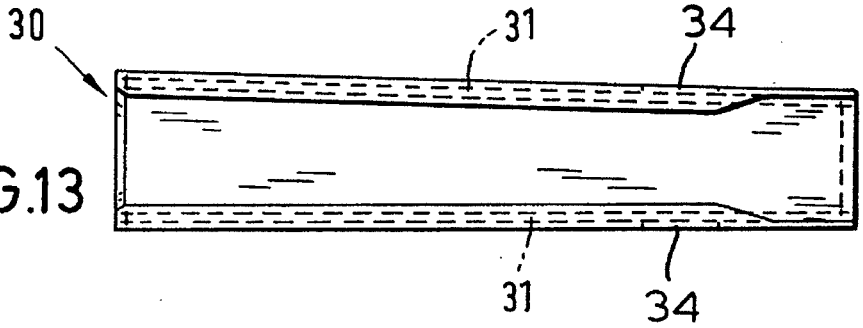

FIG..2 is a detail illustrating a side view of a portion of the head loop of the wire of FIG. 1;

FIG. 3 is a detail of a spring element at an end portion of one of the shanks of the wire of FIG. 1;

FIG. 4A is a side elevational view of a brush head receivable in the loop of the wire of FIG. 1;

FIG. 4B is a cross section through the brush head of FIG. 4A taken perpendicular to the longitudinal axis thereof;

FIG. 4C is a plan view of the brush head;

FIG. 5 is a side view of a handle adapted to receive the shanks of the wire of FIG. 1;

FIG. 6 is a plan view of the handle;

FIG. 7 is a plan view of the brush with the brush head removed, showing the shanks fitted into the handle;

FIG. 8 is a side view of the toothbrush of FIG. 7;

FIG. 9 is a view similar to FIG. 7 but showing one of the end portions released from the handle and the open loop adapted to receive a brush head of FIGS. 4A–4C;

FIG. 10 is a side elevational view of the brush of FIG. 7 in a housing shown in cross section;

FIG. 11 is a side elevational view of the housing of FIG. 10;

FIG. 12 is a section through the housing of FIG. 10 and 11;

FIG. 13 is a plan view of this housing; and

Figure 14:
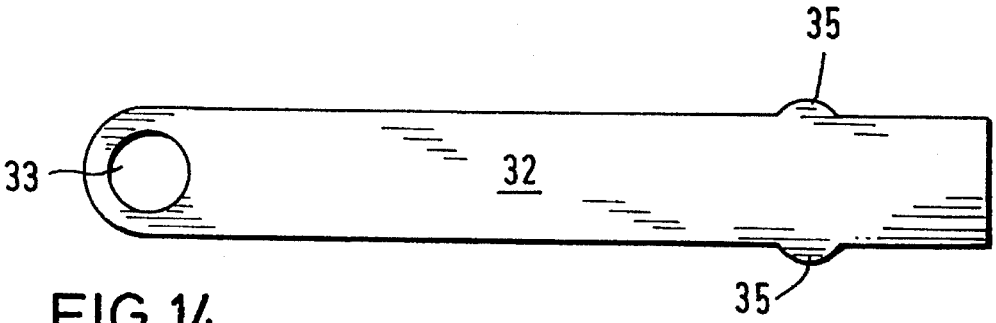

FIG. 14 is a plan view of a housing cover plate.

SPECIFIC DESCRIPTION

The toothbrush, shown as a whole at 10 in the drawing, is comprised of a spring steel wire 11 which is preferably composed of nickel-free V4A medicinal steel. The wire 11 is subdivided into two shanks 12 of different lengths which join in a head part of portion 13 constituting a loop which can receive a brush head 14, a stem 15 on two shank end portions 16 releasably engageable in a handle 17.

At the junction between the stem 15 and the end portions 16 of the shanks, the two shanks 12 have opposite springs 18 made up each of a plurality of turns of the spring steel wire. The coil springs 18 have axes w which are inclined outwardly away from the longitudinal axis x of the toothbrush 17 toward the end portions. The angle $\alpha$ between the longitudinal axis x and the coil axis w in each case can be anywhere between 0° and 90° depending upon the spring characteristics desired and the degree of mobility of the loop 13 which is preferred. A typical angle is about 45°.

While the shorter end portion 16 of the wire 11 has a simple stiffening bend 19, the longer end portion 16 of the other shank, is bent toward the head portion 13 at 20 before being provided with the stiffening bend 21 so as to form an additional spring element at 20. The end 21 also has a portion 22 bent out of the plane of the shanks of the wire and whose function will be described further below.

After the brush head 14 (FIGS. 4A–4C) has been inserted into the loop formed by the head portion 13, the two shanks 12 can be brought together and inserted into a guide 23 of the handle 17. The bend 22 thus forms an orienting member which facilitates the sliding of the shanks into the handle and allows the bend 21 to be guided along the straight lower edge 23 on the guide 23. The other edge 23" may be stepped at 23'''.

The end portions 16 of the wire 11 are introduced into the handle 17 until, as can be seen from FIG. 7, the bend 21 is indexed in an opening 24 of the handle.

To simplify the positioning of the brush head 14 in the loop 13, on opposite sides of the latter, mirror symmetrical juts 26 bent from the plane of the loop, are provided, to engage in corresponding recesses 27 of the brush head 14. The wire 11 of the loop 13 can engage in a peripheral groove 28 of the brush head 14. The juts 26 and the recesses 27 which receive them prevent an improper orientation of the head 14 in the loop 13.

In FIGS. 4A–4C, the brush head 14 is shown to have alternating rows of shorter and longer bundles of bristles, preferably composed of synthetic resin filaments. The shorter bundles of bristles serve to clean the surfaces of the teeth while the longer bundles of bristles clean between the teeth and massage the soft tissue surrounding the teeth.

As has been shown especially in FIG. 9, when the wire 11 is advanced so that the bend 21 is indexed in an opening 29 spaced closer toward the head end of the handle 17 than the opening 24, the bend 19 of the shorter shank is released to allow the loop 13 to open and release the brush head 14 or receive another brush head 14. Thereupon the loop 19 can be swung toward the longer shank and reinserted in the guide 23. The bend 22 projecting above the edge 23', permits the bend 21 to be swung inwardly out of the indexing window 29 so that the wire 11 can be inserted further into the handle 17 into the position shown in FIGS. 7 and 8.

For use of the toothbrush 17, once a brush head is in place and the assembly is in the position 1 shown in FIGS. 7 and 8, the user can place the hand around the handle 17 so that the thumb engages a thumb rest D at the end of the handle 17 turned toward the loop 13. The bristles are applied against the teeth and the loop 13 and the head can be moved against the teeth and the soft tissue. The head can move with respect to the stem 14 in all directions perpendicular to the axis x by reason of the springs so that injury to the teeth or the soft tissue is prevented during both normal brushing movements and return movements.

An axial movement is permitted against the forces generated by the spring element 20 where necessary.

As can be seen from FIG. 10, the handle 17 can be mounted in a housing 30 which can be affixed to a wall or the like, by sliding the handle 17 into a guide 31 of this housing. The housing can accommodate a number of brush heads 14 and can be used for storing the toothbrush and as a sales packaging. The loop 36 at the end of the toothbrush can be used as an eye to support the packaged toothbrush on a sales rack.

The housing 30 can be closed by a plate 32 (FIG. 14) having an opening 33 for wall attachment. The plate 32 can be inserted into the guide 31 as well and can have projections 35 engaging in arresting slits 34 of the housing. If desired electric drive 37 can be mounted on the handle (FIG. 7) to vibrate the end portion 16 of the shanks and impart vibration of the brush head.

I claim:

1. A toothbrush comprising:

an elongated brush head having a longitudinal axis;

a support formed from a continuous spring-steel wire and defining an elongated loop constituting a head portion receiving said brush head and a stem portion connected with said head portion and formed by two shanks of said wire, said shanks being formed with respective coil springs, each of said coil springs having a plurality of turns of said wire enabling elastic displacement of said head in all directions transverse to said axis of said head, said shanks having end portions extending away from said springs; and a handle removably fitting over said end portions for drawing said end portions together and closing said loop to retain said brush head in said head portion, said loop opening to release said brush head upon release by said handle of said end portions, said springs each having a coil axis inclined to said longitudinal axis outwardly toward said end portions, one of said end portions being displaceable toward said longitudinal axis upon sliding of said handle over said end portions, both of said end portions being receivable at least in part in said handle upon shifting of said handle over said end portions, thereby exerting a force on said head portion counter to a spring force of said wire, said handle having a guide track for said end portions formed with openings in which at least one of said end portions is indexable.

2. The toothbrush defined in claim 1 wherein said one of said end portions has a spring element biasing said one of said end portions into said openings.

3. The toothbrush defined in claim 2 wherein said wire and said handle are composed of V4A medicinal steel.

4. The toothbrush defined in claim 3, further comprising a housing receiving said handle, said housing having a compartment receiving at least one said brush head.

5. The toothbrush defined in claim 4 wherein said handle has a thumb rest formed by a piece of the handle turned back on itself.

6. The toothbrush defined in claim 5 wherein said loop is formed on opposite sides of said head with respective juts fitting into corresponding recesses formed in said brush head.

7. A toothbrush comprising:

an elongated brush head having a longitudinal axis;

a support formed from a continuous spring-steel wire and defining an elongated loop constituting a head portion receiving said brush head and a stem portion connected with said head portion and formed by two shanks of said wire, said shanks being formed with respective coil springs, each of said coil springs having a plurality of turns of said wire enabling elastic displacement of said head in all directions transverse to said axis of said head, said shanks having end portions extending away from said springs; and a handle removably fitting over said end portions for drawing said end portions together and closing said loop to retain said brush head in said head portion, said loop opening to release said brush head upon release by said handle of said end portions said handle having a guide track for said end portions formed with openings in which at least one of said end portions is indexable.

8. The toothbrush defined in claim 7 wherein said one of said end portions has a spring element biasing said one of said end portions into said openings.

9. A toothbrush comprising:

an elongated brush head having a longitudinal axis;

a support formed from a continuous spring-steel wire and defining an elongated loop constituting a head portion receiving said brush head and a stem portion connected with said head portion and formed by two shanks of said wire, said shanks being formed with respective coil springs, each of said coil springs having a plurality of turns of said wire enabling elastic displacement of said head in all directions transverse to said axis of said head, said shanks having end portions extending away from said springs; and a handle removably fitting over said end portions for drawing said end portions together and closing said loop to retain said brush head in said head portion, said loop opening to release said brush head upon release by said handle of said end portions, said handle has a thumb rest formed by a piece of the handle turned back on itself.

10. A toothbrush comprising:

an elongated brush head having a longitudinal axis;

a support formed from a continuous spring-steel wire and defining an elongated loop constituting a head portion receiving said brush head and a stem portion connected with said head portion and formed by two shanks of said wire, said shanks being formed with respective coil springs, each of said coil springs having a plurality of turns of said wire enabling elastic displacement of said head in all directions transverse to said axis of said head, said shanks having end portions extending away from said springs; and a handle removably fitting over said end portions for drawing said end portions together and closing said loop to retain said brush head in said head portion, said loop opening to release said brush head upon release by said handle of said end portions, said loop being formed on opposite sides of said head with respective juts fitting into corresponding recesses formed in said brush head.

* * * * *